United States Patent [19]

Schweizer

[11] 4,212,401

[45] Jul. 15, 1980

[54] DEVICE FOR STORING OBJECTS, IN PARTICULAR CARD-LIKE OBJECTS

[76] Inventor: Eduard H. Schweizer, 5101 Boarshead Rd., Minnetonka, Minn. 55343

[21] Appl. No.: 878,447

[22] Filed: Feb. 16, 1978

[30] Foreign Application Priority Data

Feb. 24, 1977 [CH] Switzerland ..... 2301/77
Sep. 21, 1977 [CH] Switzerland ..... 11543/77

[51] Int. Cl.[2] ..... A47G 29/00

[52] U.S. Cl. ..... 211/81; 211/170; 206/425; 206/45.18

[58] Field of Search ..... 211/11, 40, 81, 169.1, 211/170; 206/425, 424, 45.18

[56] References Cited

U.S. PATENT DOCUMENTS

| | | | |
|---|---|---|---|
| 213,040 | 3/1879 | Duryee | 206/425 |
| 617,832 | 1/1899 | Kling | 206/425 X |
| 980,234 | 1/1911 | Field | 206/425 X |
| 1,951,408 | 3/1934 | Haven | 206/425 |
| 2,665,808 | 1/1954 | McAlister | 206/425 |
| 3,259,748 | 7/1966 | Lammers | 206/45.18 X |
| 3,910,487 | 10/1975 | Jaeschke | 206/425 X |

FOREIGN PATENT DOCUMENTS

| | | | |
|---|---|---|---|
| 2202349 | 11/1972 | Fed. Rep. of Germany | 206/425 |
| 2311519 | 1/1977 | France | 211/169.1 |
| 98862 | 8/1961 | Netherlands | 206/425 |

*Primary Examiner*—Joseph Man-Fu Moy
*Attorney, Agent, or Firm*—Cushman, Darby & Cushman

[57] ABSTRACT

A storage device for storing card-like objects, for example photographs. The device is in the form of a cassette like container in which the objects are stacked upright in a rear section comprising the base, lower parts of each side wall and the rear wall of the cassette. A first section of the cassette is pivoted about the front edge of the base and comprises at least part of the top, the front wall and upper parts of the side walls complementary with the side wall lower parts. In the open condition of the cassette photographs can readily be turned forward one by one to stack face downwards on the front section. A plurality of such cassettes may be pivotally supported in a rectangular frame, one behind the other, so that the contents of each cassette can be readily inspected in turn.

4 Claims, 10 Drawing Figures

FIG. 4
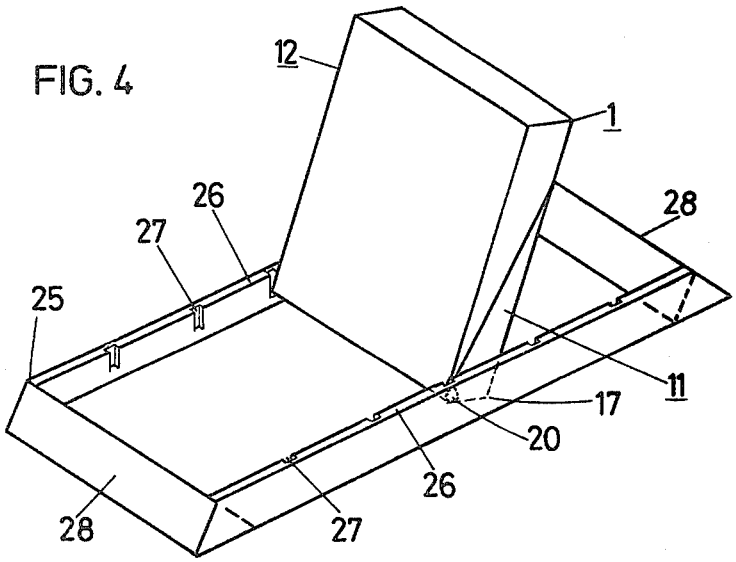
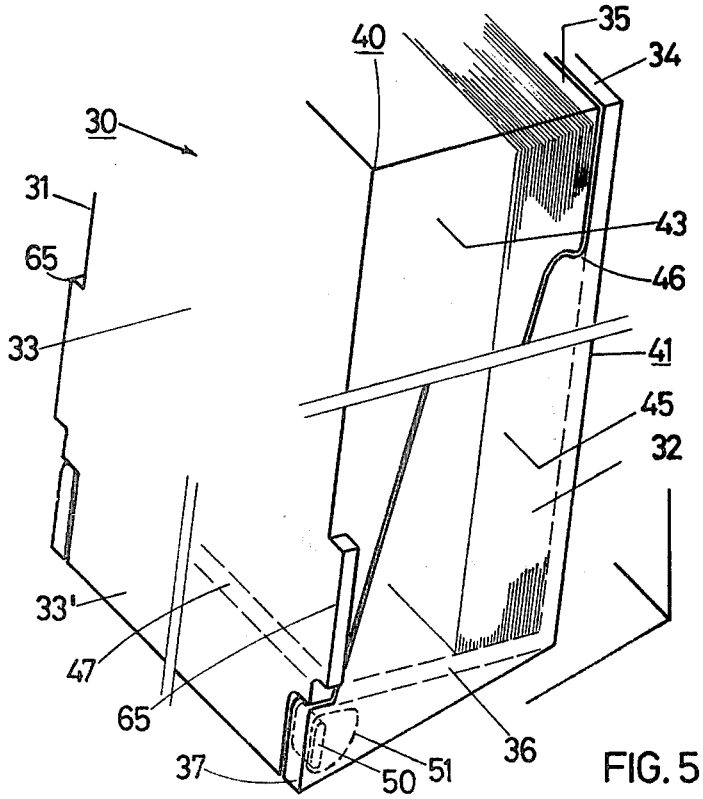
FIG. 5

DEVICE FOR STORING OBJECTS, IN PARTICULAR CARD-LIKE OBJECTS

This invention relates to a device for storing objects, in particular objects of a card-like nature, such as photographs, in a manner such that they can be sorted through, which has a front wall and a back wall, a pair of narrow sides and a top section and a base section, which together form a container which can be opened and closed and in which the objects are placed vertically, on the base section.

Objects for collection and for viewing, in particular objects of a card-like nature, for example photographs and postage stamp covers, are usually stored in albums. Compared with the object for collection, such albums are relatively heavy and voluminous and are, therefore, unmanageable. A further disadvantage of albums is their comparatively low capacity with respect to their cost and the space occupied. Moreover, collected material which has been arranged once is troublesome to rearrange. The unmanageability is shown, for example, by the fact that objects for collection cannot be held close to the eyes for viewing, although this is frequently desired, for example for photographs and postage stamps. Card-like objects for collection are therefore often stored without being arranged, for example in boxes.

It is known from filing technique to arrange index cards by standing them in card-index boxes. However, without exception the field of view when leafing through the index cards is severely restricted, so that only a card which has been removed can be read easily, which is undesirable, for example, for valuable covers and furthermore makes ordered storage difficult. Moreover, index cards for purposes other than filing purposes are unattractive to the extent that wider use of the index card principle is of no interest.

It is also known to display individual card-like articles for viewing, for example photographs, in slip-in frames which can be stood up. Such a slip-in frame contains, for example, a suitable supported cover-glass, under which an individual photograph, which can be replaced, can be placed. These viewing devices are not suitable for more extensive storage use but only for the display of individual pictures.

The aim of the invention is to provide a device for storing objects to be collected, in which the objects are arranged vertically. In particular, the device should fulfill the following requirements: storage of the collected material which affords protection against environmental influences, for example dusting, manageability and possibility of easy inspection of individual articles for viewing, when arranged, possibility of removing the articles for viewing and correspondingly easy rearrangement of the collected material. Besides making it possible to store a number of objects in such a manner that they can be sorted through, the device should also make it possible to display individual articles for viewing, for example photographs. The latter purpose requires the appearance of the device to be attractive, and a presentation effect which is not impaired by the objects additionally stored. Furthermore, it should be possible to develop and inexpensively manufacture the device in a manner such that it can be employed, for example, as packaging material for the photographic industry. Finally, it should be possible to extend as desired the capacity, of the device, for storage of objects.

According to the invention there is provided a storage device for storing card-like objects which is in the form of an openable and closeable container having front and back walls, narrow side walls, a top wall and a base, said container comprising one front section comprising the entire front wall, at least part of the top wall and the upper parts of the side walls and one rear section comprising the back wall, the base and lower parts of the side walls complementary with said upper parts to form the complete side walls in the closed condition of the container, said front and rear sections being connected for pivotal movement about the front edge of the base between open and closed positions, whereby in said open position a stack of objection supported upright in said rear section can readily be turned forward one by one to be stacked on the inside of said front wall.

In the following text, the invention is described in more detail for some embodiments with the aid of the accompanying drawings. In the drawings:

FIG. 4 shows a simplified perspective representation of a stand for the support of several of the storage devices, one such device being shown held therein;

FIG. 5 shows a simplified perspective representation of a further embodiment of a storage device;

Figure 1:
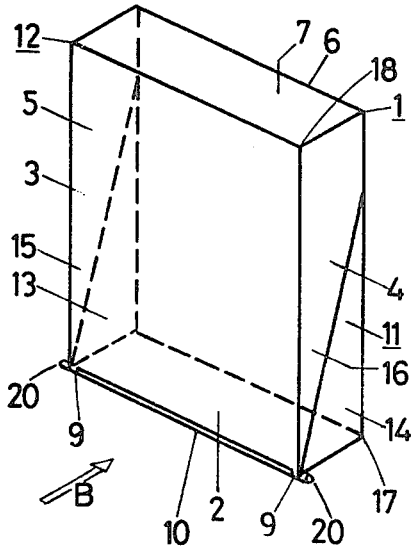
FIG. 1 shows a simplified perspective representation of a card storage device in the closed position, standing on its base.
Figure 3:
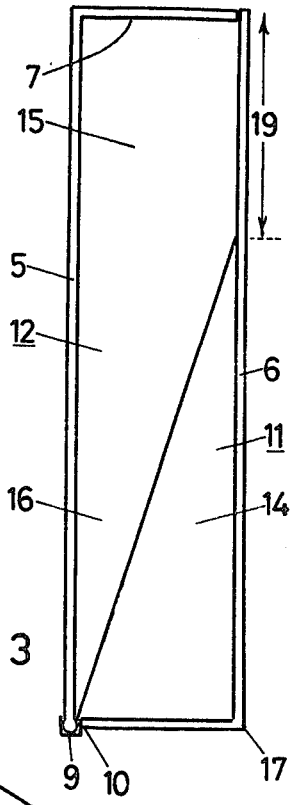
FIG. 3 shows a side view of the device in FIG. 1.
Figure 2:
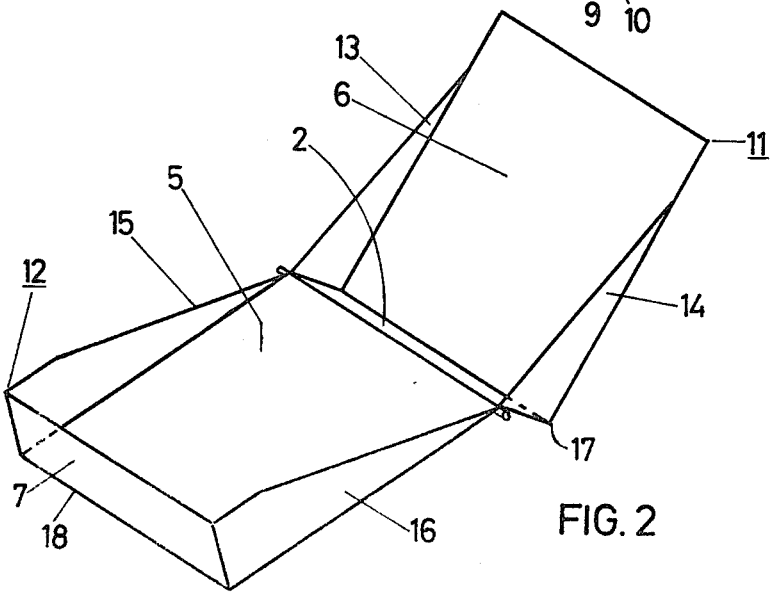
FIG. 2 shows a simplified perspective representation of the device according to FIG. 1 when opened.

With respect to the embodiment in FIGS. 1–3, the storage device shown in FIG. 1, when closed, is in the form of a rectangular cassette 1. The base section of the device, called cassette 1 in the following text, is formed by the cassette bottom 2. The definition "cassette bottom" indicates that in this orientation of the cassette 1 the objects contained therein, for example photographs, assume a position vertical to the bottom 2. The photographs are also arranged in a manner such that their picture sides face the viewing direction B. On the basis of this orientation, cassette 1 can be defined by a left side wall and a right side wall parallel thereto, 3 and 4 respectively, a front wall 5 and a back wall 6 parallel thereto, and a top wall 7 parallel to the bottom 2. All these wall elements 2 to 7 are preferably made from glass-clear, hard, scratch-resistant plastics, for example polystyrene. The front and back wall 5, 6 have appropriate dimensions corresponding to customary sizes of photographs. The cassette 1 is designed, for example, for storing instant-picture photographs.

Cassette 1 is constructed in two sections and consists of a rear section 11 and the front section 12. Both sections 11, 12 are pivotally connected along the front edge 10 of the bottom 2 by a hinge connection 9. The rear section 11 comprises the bottom 2, the back wall 6 and the lower sections 13, 14 of the side walls 3, 4. The front section 12 comprises the front wall 5, top wall 7 and the upper sections 15, 16 of the side walls 3, 4 complementary to the lower sections 13, 14. Both the front section 12 and the rear section 11 have a container-like shape with the same particular capacity for storage of photographs as the closed cassette 1.

FIG. 2 shows how, in the opened position, the cassette 1 is supported by two edges 17, 18 acting as standing edges. The standing edge 17, belonging to the back section 11, is the edge where the bottom 2 and the back wall 6 meet, whilst the standing edge 18 of the front section 12 runs between the top wall 7 and the front wall 5. In the opened position, the edge 10 thus forms a ridge at the juncture of the bottom 2 and front wall 5. The device 1 can always be brought into the position shown in FIG. 2 since there is an underlying balance which is always maintained, independently of the extent to which the front section 12 of the back section 11 is filled. This state of balance results from two moments of rotation acting in opposite directions on the rotating edge 10.

As FIG. 2 shows, two containers which are open on the upper side, of identical size and arranged in series, are available for viewing and sorting through the collected material. It is therefore obvious to the user to tilt the photographs stacked in the back section 11 into the front section 12, by turning them over round the rotating edge 10, and to stack them up there. The slope of the front wall 5 ensures that the photographs slip into the front section 12 without assistance. The turning over does not require removal of the photographs from the cassette 1. Rather, the photographs can be simply turned over using a finger. For this purpose, each of the lower sections 13, 14 of the side walls 3, 4 expose a holding area 19 at the sides in the back section 11, which enables the stack of photographs to be conveniently handled in the upper region.

There would, of course, be the possibility of enclosing both the back section and front section 11, 12 at the sides with complete side walls. For this, a greater inside width between the side walls would be required in one of the sections 11, 12. It has been shown, however, that as well as being more expensive, such a construction makes more difficult an unimpeded turning over and/or closing of both the sections 11, 12 when the device is filled, and thus would be less desirable compared with the side walls 3, 4 as illustrated having the complementary sections 13, 15 and 14, 16.

Using the device described above, the photographs can be sorted through at least as rapidly as a bundle held in the hand, 3 to 4 cassettes can even replace an unmanageable album. It is also advantageous that the very light weight cassette 1, when opened, can easily be brought to eye-level and sorted through using one hand, which is not possible in the case of a voluminous album. The cassette 1 can be inexpensively manufactured, for example by means of injection moulding, and thus it can be employed as packaging material, for example in photographic shops, instead of the customary wallets for photographs. Moreover, such a cassette 1 can have the function of a slip-in display frame for the top photograph in the stack. The cassette represented in FIGS. 1–3 has, for example internal dimensions of 27×131×91 mm, a wall thickness of 1.5 mm and a holding area 19 of 52 mm. It is thus suitable, for example, for storing a 2.7 cm thick stack of pictures 13×9 cm in size.

FIG. 4 shows how several cassetts 1 can be supported in a stand which consists of a rectangular flat frame 25, longitudinal sides 26 of the frame are each provided, on the inside, with a succession of equidistant vertical grooves 27. The grooves extend from the upper edge of the frame downwards about $\frac{2}{3}$ of the height of the frame. Pairs of opposite grooves 27 each form seats for the pin-like projections 20 which protrude out of the side walls 3, 4, on both sides of the rotating edge 10, of the cassette 1. The cassettes are therefore suspended in the frame 25 in a manner such that they can swivel on the pin-like projections 20, and are also supported on the bottom by their standing edge 17. They assume here a tilted rest position, sloping backwards. Thus if the frame 25 contains several cassettes, a desired cassette can be made available by turning over the other cassettes, without any cassette having to be removed from the frame 25. The transverse end members 28 of the frame 25, which are triangular in section, prevent the cassettes 1 tipping out of the frame 25. It can be seen that such a system has several times the capacity of a conventional album.

The storage device, which is also cassette-like and which is shown closed in FIG. 5, is designed to store larger card-like objects broadside on and is especially suitable for building up a system containing several such cassettes. The cassette 30 comprises side walls 31, 32, front wall 33, back wall 34 and top wall 35. The base section consists of the bottom 36, indicated by dashed lines, and the wedge-shaped feet 37; the projections are the side walls 31, 32. The feet 37 cause the cassette position to be inclined backwards somewhat, with the cassette 30 standing on a horizontal base, the stability being maintained. The cassette is constructed from two sections and consists of a front section 40 and rear section 41. The front section 40 consists of the front wall 33, the top wall 35 and the upper sections 42, 43 of the side walls 31, 32. The back section 41 comprises the back wall 34, the bottom 36 with feet 37 and the lower sections 44, 45 of the side walls 31, 32 complementary to the upper sections 42, 43, as can also be seen from FIG. 7. As already illustrated previously, it is particularly advantageous to divide the side walls 31, 32 into complementary sections 42, 44 and 43, 45 in order to make unimpeded restacking of the collected material possible and furthermore so that the sections 40, 41 can be closed without hindrance when, for example, they are each half-filled. The closed position of the cassette is arrested by the engagement connection 46 between the sections 42, 44 and 43, 45.

The front section 40 is hinged to the rear section 41 in a manner such that when moved into the opened position, the front wall 33 rotates round the front edge 47 of the bottom 36. The hinge joint comprises an oblong section peg 50 which is moulded on to the side edge of the lower end 33' of the front wall 33. This peg 50 projects into a sector-shaped groove 51 which forms a depression in the inside of the foot 37, the radius of the groove corresponding to the length of the peg. There is a corresponding hinge joint, not shown, on the opposite side wall 31. When the front section and back section 40, 41 are opened, the lower end 33' of the front wall 33 is rotated under the bottom 37. During this, the peg 50 rotates in the groove 51. A stable, in particular wobble-free, holding of the front section 40 to the back section 41 results from the comparatively large guide surface.

Figure 6:
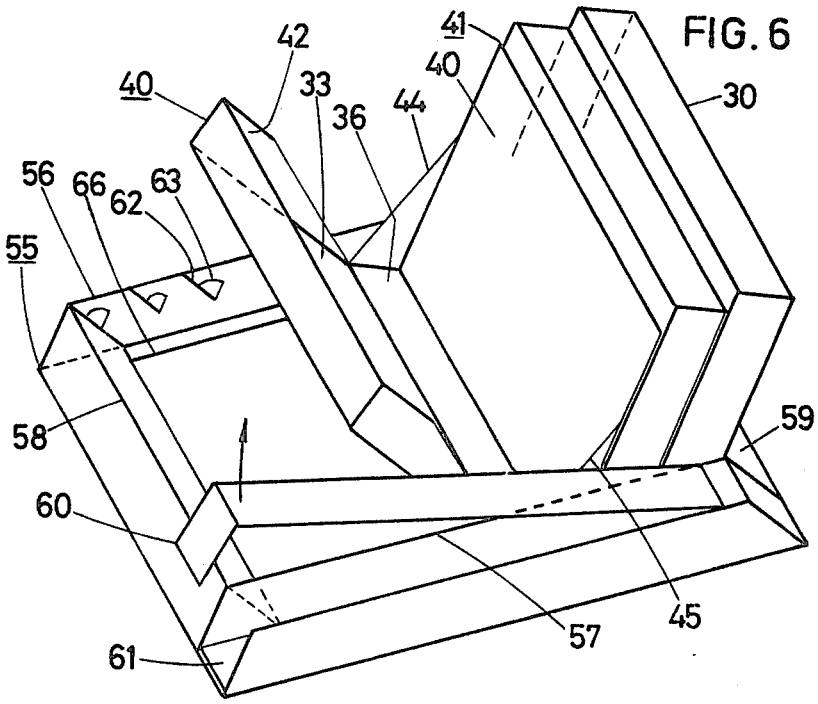
FIG. 6 is a simplified perspective representation of a support stand containing several of the devices of FIG. 5.
Figure 7:
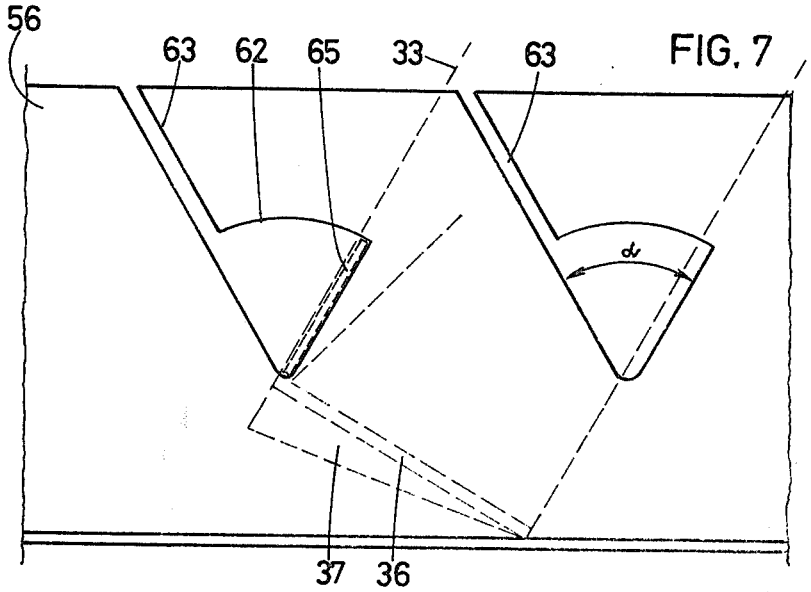
FIG. 7 is a side view of a detail of the inside construction of the frame of stand shown in FIG. 6.

FIGS. 6 and 7 show a device in the form of a collection system which contains several cassettes 30 according to FIG. 5. The support stand of the system comprises a flat rectangular frame 55 which is constructed with parallel longitudinal sides 56, 57 and transverse ends 58, 59, which are triangular in cross-section. In addition, a compartment 61 provided with a lid 60 extends the length of the external wall of the longitudinal side 57 and is envisaged, for example, for storing negatives of photographs. The inside of the longitudinal sides 56, 57 of the frame have pairs of identical rests 62 opposite one another for holding the cassettes 30. The rests 62 are in the form of depressions, in the longitudinal sides 56, 57, in the shape of vertically symmetric sectors with an aperture angle $\alpha$ of, for example, 60°. In addition, radial grooves 63, which at the top open out of the longitudinal sides 56, 57 of the frame, lead into the rests 62.

A projecting ridge 65 is moulded onto each of the side edges of the front wall 33 of the cassette above the bottom 36 in order to hold the cassettes 30 in the rests 62 (FIG. 5). The ridges 65 have a length corresponding to the radius of the rests 62 and can be introduced into the rests 62 through the grooves 63. The type of suspension by means of ridges 65 which can be rotated in sector-shaped rests 62 makes wobble-free turning and holding of the cassettes 30 in the frame 55 possible. As can be seen, a cassette 30 can be either swivelled in its entirety or opened for display of its contents. The swivelling angle and opening angle are identical and correspond to the aperture angle $\alpha$ of the rests 62. The elevational view of FIG. 7 of the internal wall of the longitudinal side 56 of the frame shows that the successive rests 62 have a separation which corresponds to the thickness of the cassette 30. The cassette 30, indicated with dotted lines, is appropriately supported on the bottom 66 of the frame in a backward-inclined position. As can be seen, even when the frame 55 is completely filled with cassettes 30, each individual cassette 30 can be opened. If the device according to FIGS. 6 and 7 is provided with transparent cassettes 30, it is outstandingly suitable, for example, as a presentation system for displaying objects, for example postage stamp cards or covers, or coin collections.

Figure 8:
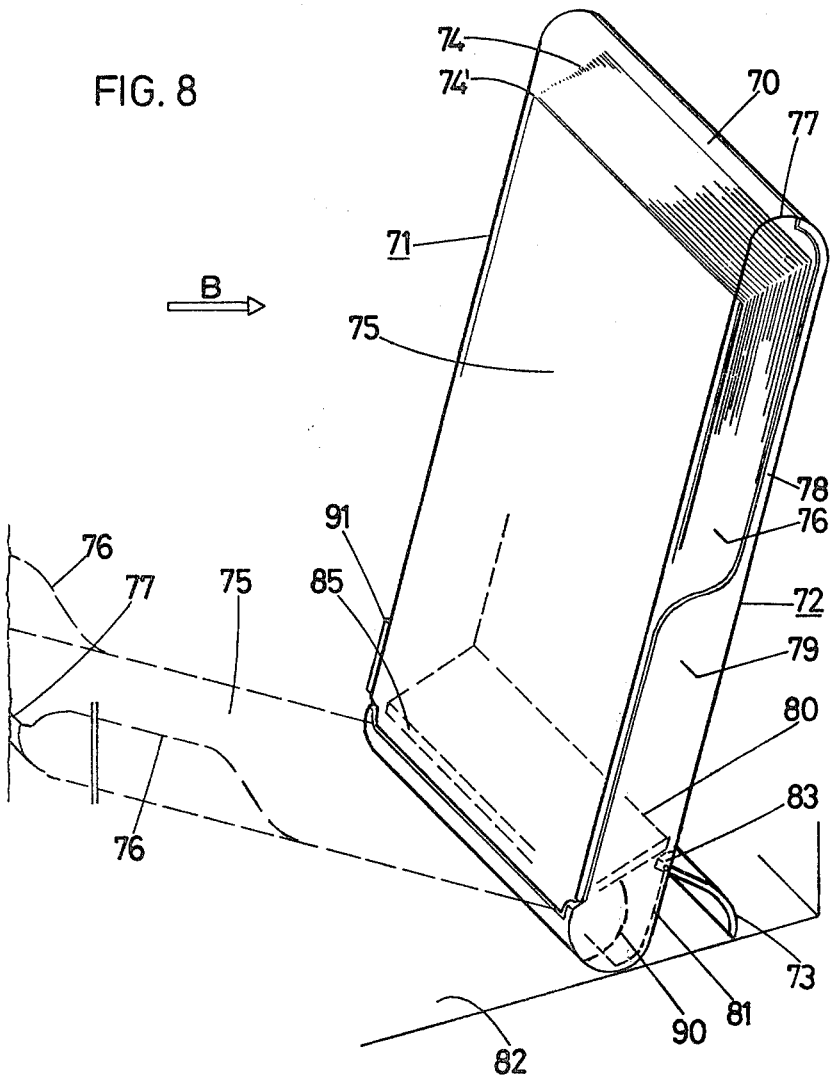
FIG. 8 is a simplified perspective view of a storage device for photographs, which at the same time has the function of a slip-in frame, some of the individual components being represented out of proportion.
Figure 9:
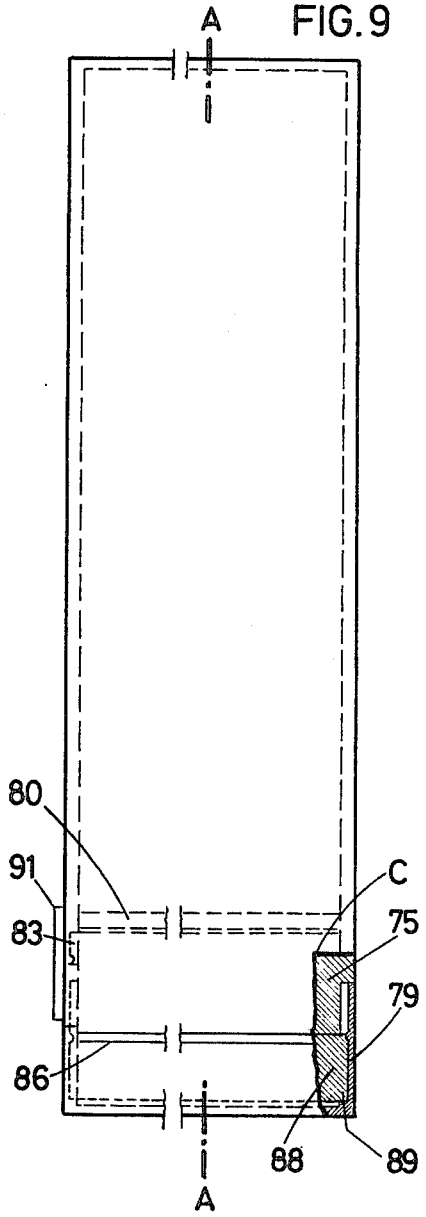
FIG. 9 is a plan view of the device according to FIG. 8 with a partial section C along the line C-C in FIG. 10.
Figure 10:
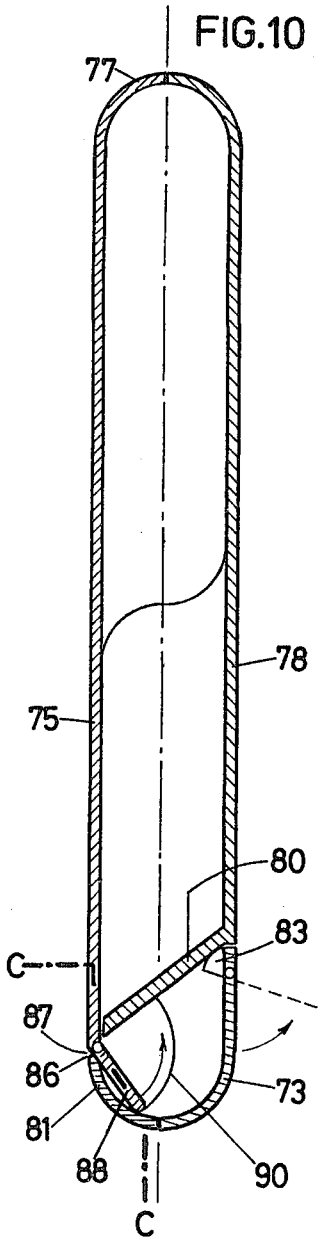
FIG. 10 is a section taken along the line A-A in FIG. 9.

The embodiment shown in FIGS. 8–10 has the double function of a slip-in frame and a collection container. In its position as shown in FIG. 8, the device can serve as a viewing unit for displaying an individual photograph. The device is essentially constructed from three sections; from the front section 71, the rear section 72 and the support 73. When closed together, the front section 71 and rear section 72 form a container 70, in the inside of which a stack of photographs 74 is stored, the uppermost photograph 74' of which, seen in the viewing direction B, is displayed. For this purpose, the front section 71 is transparent and consists, for example, of glass-clear plastics, whilst the remaining sections of the container are injection-moulded from opaque plastics and have, for example, a black lacquered appearance.

The front section 71 consists of the front wall 75, the side-wings 76 and a part 77 of the rounded top section of the device. The rear section 72 comprises the back wall 78, the lower sections 79 of the side wall, which are complementary to the side-wings 76, and the base section of the device. The base section of the device comprises the support 73 mentioned, a bottom 80 and the base side 81, rounded in the form of a semi-circle, of the device. When used as a viewing unit as shown in FIG. 8, the position of the device is such that it leans backwards, relative to a horizontal supporting surface 82. The base side 81 and support 73 together form the stand for this position of the container. The support 73 and the angle at which it swings out are such that a stability which is adequate for the intended use results. As can be seen, the device in the position according to FIG. 8 has all the properties and characteristics of a slip-in frame: display of the picture 74' in a position inclined towards the viewing direction B, the possibility of replacement and attractive exterior. On the other hand, the stack 74 cannot be seen as such, but fills in the outlines of the back section 72 to give a background, which is seen to be compact, to the picture 74' on display.

As can be seen from FIG. 10, the bottom 80, grooved on the upper side, is moulded to the back wall 78 and slopes downwards to the lower edge of the front wall 75. The support 73 is held below the bottom 80 in sector-shaped rests 83 which are in the form of depressions on either side in the sections 79 of the side wall. The angle of the rest 83 hereby determines the angle at which the support 73 swings out.

The front edge 85 of the bottom 80 and the upper edge 86, parallel thereto, of the base side 81 form a horizontal gap 87 at the transition from the front wall 75 into the curvature of the base side 81. A wall element 88 at an angle to the front 75 passes through the gap 87. The wall element 88 is perpendicular here to the bottom 80 when the container 70 is closed. Accordingly, the front section 71 can be opened by a right angle, in the position indicated as dotted lines in FIG. 8. The wall element 88 is here adjacent to the underside of the bottom and carries the weight of the front section 71.

The front section 71 is held so that it can be rotated between the sections 79 of the side walls. As the partial section A in FIG. 9 illustrates, the wall element 88 has a projecting ridge 89 at the side. There is a rest 90 in the form of a sector-shaped depression, the radius of which corresponds to the length of the ridge 89, in the section 79 of the side wall. During the rotation movement, the ridge 89 passes over the sector 90 like a radius vector, and ensures wobble-free guiding of the front section 71.

When used for collection purposes the container 70 can be held in the hand so that when sorting through or turning over, each picture 74 readily slips into the front section 71 and is stacked up there. It is, of course, also possible to build up a collection system with this device. For this purpose, for example, a projecting ridge 91, which is only indicated for the left side edge in FIGS. 8 and 9, is moulded onto the side edges of the front wall 75. Using such ridges 91, the container 70 can be held, in a manner such that it can be rotated, in a frame similar to that represented in FIGS. 6 and 7.

If desired, the various storage devices above described can also be employed for filing purposes, or as card indexes. Possible objects which can be collected and sorted through are not only those of a card-like nature. Rather, it is also possible to store, for example, rod-like, round or oblong objects. A mechanism for holding objects which is accommodated in the cassettes or devices is also conceivable. The front section and back section do not necessarily have to be solid throughout, but can have openings. Each cassette-like device can contain an arrangement for closing it. For holding several devices, it is also possible to use stands or other means which are other than frame-like, for example those with drawers for the devices.

I claim:

1. A device for storing and showing objects, particularly card-like objects, comprising:

a stand including a generally rectangular flat base and upstanding parallel longitudinal sides provided on their opposed inner surfaces with a plurality of pairs of opposed groove means defining bearing means; and a plurality of generally rectangular, generally flat openable and closeable containers for the objects adapted to be stacked generally upright in said stand, each of said containers having a base portion and wherein a plurality of the objects can be arranged vertically supported on said base portion, each of said containers having a front section and a rear section which includes said base portion and having means pivotally connecting said sections for pivotal movement about the front edge of said base portion between a closed position and an open position, whereby in said open position a stack of objects supported upright in said rear section can readily be turned forward one-by-one to be stacked on the inside of said front section, each of said containers also including a pair of projections on its opposite sides adjacent said base portion adapted to be received in a pair of said bearing means to permit tilting movement of said container in said stand between forwardly and rearwardly inclined positions, whereby when a pair of adjacent containers is tilted apart the rearward of said containers can be opened as aforesaid, the lower ends of said groove means and said base portion of each container being arranged and proportioned so that the rear edge of said base portion engages said stand base when a container is in its rearwardly inclined position to serve as a stop means to maintain the container in such position, and wherein said stand is provided with an upstanding front side engageable by the foremost of the containers when the latter is in its forwardly inclined position to serve as a stop for maintaining said container in such position.

2. A device according to claim 1 wherein the groove means are substantially straight, vertical and open at their upper ends, and wherein the projections constitute extensions of the means pivotally connecting the sections.

3. A device according to claim 1 wherein each groove means includes a lower portion in the shape of a symmetric sector with the apex pointing downwards and another portion in the shape of a straight groove having one side thereof constituting an extension of a flat side wall of the sector and extending to the upper edge of the longitudinal side of the stand, and wherein each projection is in the form of a flat ridge having a length corresponding to the radius of said sector.

4. A device according to claim 1 wherein each container includes a front wall, a back wall, a pair of narrow side walls, and a top wall, which together with the base portion form the container, and wherein the front section includes the entire front wall at least a part of the top wall and upper parts of the side walls, and wherein the rear section includes the back wall, the base portion and lower parts of the side walls complementary with said upper parts to form the complete side walls in the closed position of the container.

* * * * *